US005605397A

United States Patent [19]

Oberg et al.

[11] Patent Number: 5,605,397

[45] Date of Patent: Feb. 25, 1997

[54] SYSTEM FOR MIXING CEMENT AND AGGREGATE

[75] Inventors: Neil G. Oberg, Milliken; Jerome J. Doherty, Berthoud, both of Colo.

[73] Assignee: Port-A-Pour, Inc., Berthoud, Colo.

[21] Appl. No.: 608,764

[22] Filed: Feb. 29, 1996

[51] Int. Cl.[6] ..... B28C 5/00

[52] U.S. Cl. ..... 366/2; 366/14; 366/18; 366/20; 366/35; 366/38

[58] Field of Search ..... 366/2, 6, 8, 9, 366/14, 16, 18, 20, 27, 30, 33, 35, 38, 54

[56] References Cited

U.S. PATENT DOCUMENTS

| | | | |
|---|---|---|---|
| 3,162,316 | 12/1964 | Camp | 366/18 |
| 3,306,589 | 2/1967 | Uden | 366/16 |
| 4,298,288 | 11/1981 | Weisbrod | 366/35 |
| 4,795,264 | 1/1989 | Riker | 366/35 |
| 5,171,121 | 12/1992 | Smith et al. | 366/33 |

*Primary Examiner*—Robert W. Jenkins
*Attorney, Agent, or Firm*—Dean P. Edmundson

[57] ABSTRACT

A system and method for mixing particulate cement with mineral aggregate(s) so as to minimize the formation and escape of dust. The system involves dispensing aggregate(s) downwardly from a hopper and simultaneously dispensing the cement particles from a tube within the aggregate hopper above the hopper opening. The cement particles adhere to moisture on the surface of the aggregate(s).

11 Claims, 2 Drawing Sheets

SYSTEM FOR MIXING CEMENT AND AGGREGATE

FIELD OF THE INVENTION

This invention relates to mixing of particulate cement with mineral aggregate. More particularly, this invention relates to a method and system for pre-blending particulate cement and mineral aggregate to minimize dust and escape of particulate cement into the atmosphere.

BACKGROUND OF THE INVENTION

In the formulation of concrete it is necessary to admix particulate cement, water and one or more mineral aggregates in specific proportions. Normally, the water, cement and aggregates and other additives are added to a rotating mixing drum (either on a truck or at a fixed location) at generally the same time and then mixed for a specified period of time.

Unfortunately, particulate cement is of very fine particle size (like powder) which forms dust and escapes into the atmosphere. There has not heretofore been provided a simple and effective system for mixing particulate cement and aggregate to avoid or minimize the formation of dust and escape of cement into the atmosphere.

SUMMARY OF THE INVENTION

In accordance with the present invention there is provided a method and system for mixing particulate cement with aggregate (e.g., sand) having moisture on its surface. In one embodiment the method comprises the steps of:

(a) providing an aggregate hopper having a bottom gate section which includes an opening therein;

(b) providing an elongated tube for conveying particulate cement to a point within the aggregate hopper above the opening in the hopper; and (c) dispensing the aggregate(s) and cement through the opening while simultaneously dispensing particulate cement from the elongated tube.

The particles of cement become adhered to the surface of the aggregate during the process. This results in good initial mixing of cement with the aggregate(s), and it also minimizes the formation of cement dust which would present environmental problems.

Other advantages and features of the method and system of this invention will be apparent from the following detailed description and the accompanying drawings.

BRIEF DESCRIPTIONS OF THE DRAWINGS

The invention is described in more detail hereinafter with reference to the accompanying drawings, wherein like reference characters refer to the same parts throughout the several views and in which:

FIG. 1 is a side elevational view of a system which is very useful in the practice of this invention; and FIG. 2 is a side elevational view of a portion of the apparatus shown in FIG. 1.

DETAILED DESCRIPTION OF THE INVENTION

Figure 1:
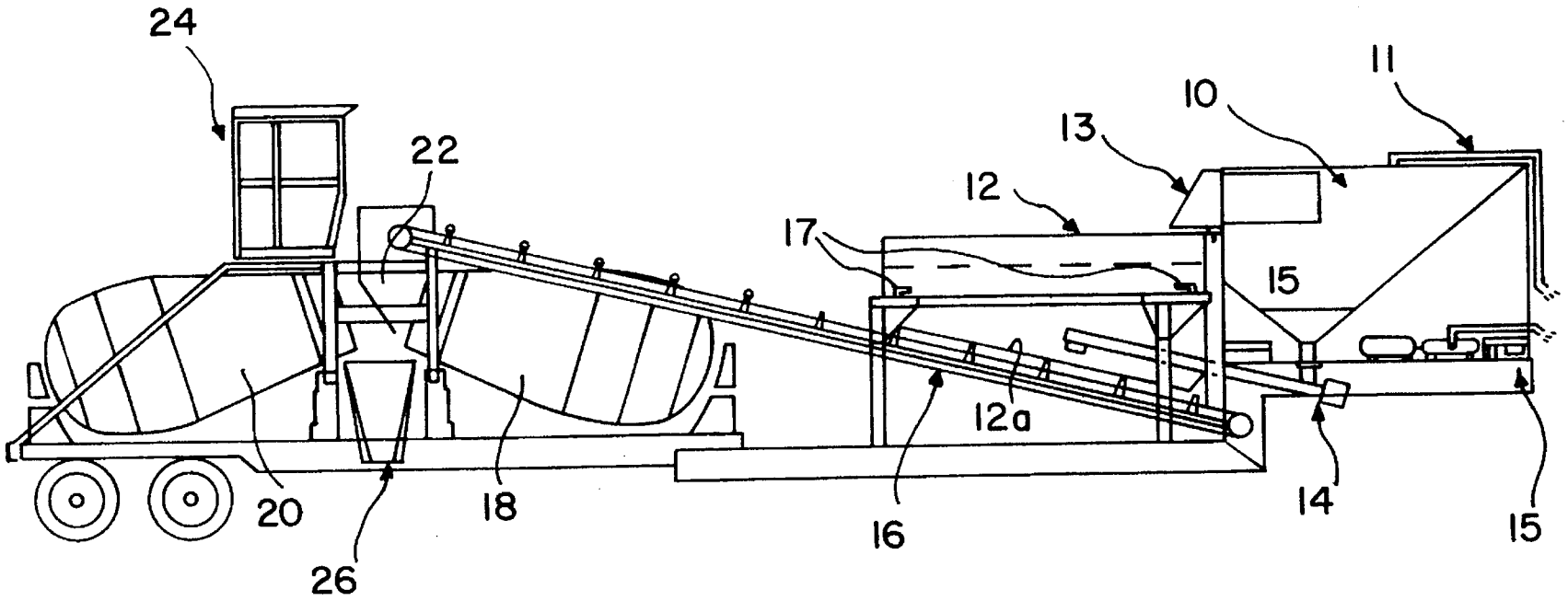
Figure 2:
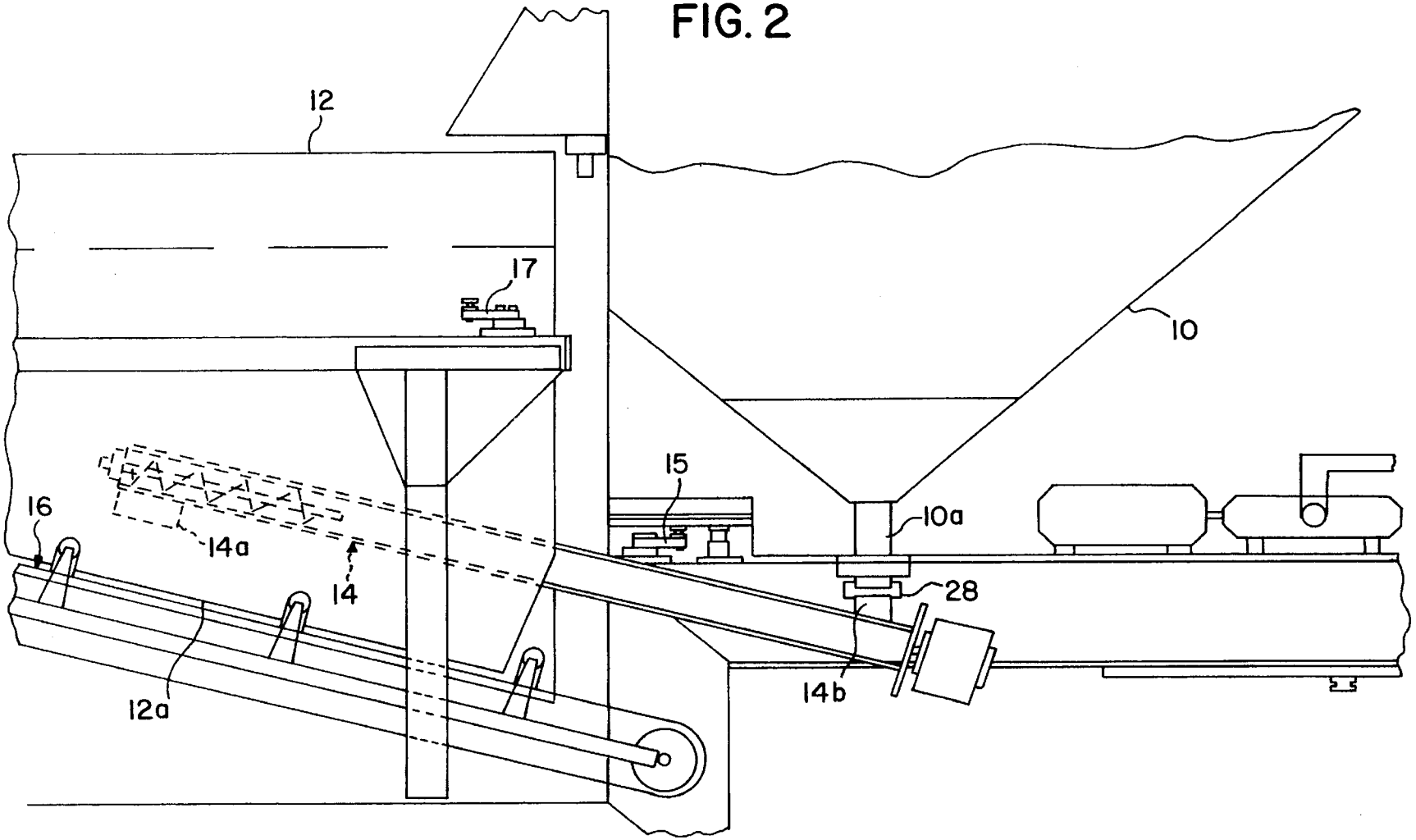

In the drawings there is shown a side elevational view of apparatus which is useful in the practice of this invention. The apparatus includes a hopper 10 for particulate cement, an aggregate hopper or bin 12, an elongated auger tube 14, an elevated conveyor 16, a first rotating mixing drum 18, a second rotating mixing drum 20, a swing chute 22 for diverting material from the conveyor to either drum 18 or drum 20, an operator cab 24, and a discharge chute 26 for receiving mixed material from the drums and discharging it into a mobile mixer or truck, for example. Particulate cement can be added to the cement hopper via inlet tube 11. A cement filter 13 may be included if desired. A cement blower and air supply are also provided. Load cells 15 are provided beneath the cement hopper so as to monitor the weight of the hopper. A rubber boot 28 is disposed between the hopper outlet 10A and the auger tube inlet 14B so that the weight sensors 15 are not affected by the connection to the auger tube 14.

A conventional air slide at the bottom of the cement hopper is used for the purpose of fluidizing the cement so that it will flow into the lower end of the elongated auger tube 14.

The mineral aggregate bin is also supported on load cells 17 so that the weight of aggregate in the bin can be monitored and controlled. The bottom of the aggregate bin includes a bottom gate and, preferably, an elongated slotted opening 12A for dispensing mineral aggregate. Other types of controlled openings could also be used, if desired.

The upper end 14A of the cement auger tube 14 is disposed directly above the opening 12A in the aggregate bin. Thus, as particulate cement is dispensed from the open end 14A of the tube 14, the mineral aggregate falls downwardly around the end 14A and then downwardly through opening 12A. The result of this is that the particulate cement is in intimate contact with the mineral aggregate. Because the surface of the aggregate typically has moisture thereon, the cement particles adhere to and are retained on the surface of the aggregate. This minimizes the formation of dust and escape of cement particles into the atmosphere. By monitoring the weight of the cement hopper and the aggregate hopper and controlling the rate of discharge of both the cement and the aggregate, it is possible to accurately control the weight ratio of cement to the aggregate for optimum blending and dust control. Preferably, the aggregate dispensing begins slightly prior to the dispensing of cement into the aggregate bin. It is also preferred to have all of the required amount of cement dispensed at a point in time prior to complete dispensing of the aggregate. For example, about 10% by weight of the aggregate should still be in the hopper when all of the cement has been dispensed.

The aggregate/cement mixture falls onto the conveyor 16 and proceeds to either mixing drum 18 or 20 or directly to a transit mixer truck, depending upon which type of mixer is chosen. After the mixture has been further mixed in one of the drums, it is discharged through chute 26 to a concrete placement system (or if a truck mixer is used, it goes to its intended destination).

Thus, the system of this invention enables the aggregate and the cement to come together prior to final mixing in mixing drums. This results in a more homogenous concrete mix and requires less mixing time in drums. This, of course, results in increased productivity and a cleaner cement handling operation.

Other variants are possible without departing from the scope of this invention. For example, blended cements can be easily handled using the system of this invention, and flyash materials can be efficiently included into the concrete mixture.

The system of the invention can be used in conjunction with all types of portable and stationary batch plants, including single and double drum plants, paddle mixer plants, and dry/wet plants for charging transit mixer trucks.

What is claimed is:

1. A method for mixing cement particles with aggregate having moisture on its surface, comprising the steps of:

(a) providing an aggregate hopper having a bottom gate section with an opening therein;

(b) providing an elongated tube for conveying particulate cement to a point within the aggregate hopper above said opening in said hopper;

(c) dispensing said aggregate and cement though said opening in said hopper while simultaneously dispensing particulate cement from said elongated tube, wherein said particulate cement becomes adhered to the surface of said aggregate.

2. A method in accordance with claim 1, wherein said elongated tube includes an auger along its length for dispensing particulate cement through an opening above said opening in said aggregate hopper.

3. A method in accordance with claim 1, further comprising the step of providing a conveyor beneath said aggregate hopper for conveying mixed aggregate and cement particles.

4. A method in accordance with claim 3, wherein the weight of particulate cement added to the aggregate is controlled.

5. A system for mixing cement particles with aggregate having moisture on its surface, the system comprising:

(a) an aggregate hopper having a bottom gate section with an elongated opening therein;

(b) a cement hopper;

(c) an elongated tube extending from said cement hopper to a point within the aggregate hopper above said opening in said aggregate hopper; wherein said tube is adapted to convey particulate cement from said cement hopper to said point beneath said opening.

6. A system in accordance with claim 5, further comprising a conveyor beneath said aggregate hopper.

7. A system in accordance with claim 5, wherein said cement hopper includes a bottom wall with an outlet port.

8. A system in accordance with claim 7, wherein said elongated tube includes first and second ends, and wherein said first end communicates with said outlet port.

9. A system in accordance with claim 8, wherein said elongated tube comprises an auger for conveying particulate cement through said tube to said second end thereof.

10. A system in accordance with claim 5, further comprising weight sensor means for monitoring the weight of said cement hopper.

11. A system in accordance with claim 5, wherein said cement hopper is connected to said tube by means of a rubber boot.

* * * * *